United States Patent [19]

Brine, III et al.

[11] Patent Number: 5,067,726

[45] Date of Patent: Nov. 26, 1991

[54] LACROSSE STICK HEAD WITH A THROAT WALL RIB AND BALL STOP MEMBER

[75] Inventors: William H. Brine, III, Mendon, Mass.; Peter J. Brine, Hanover, N.H.

[73] Assignee: Sports Licensing, Inc., Hanover, N.H.

[21] Appl. No.: 628,419

[22] Filed: Dec. 14, 1990

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| D. 28,666 | 11/1986 | Brine | D21/210 |
| 2,508,519 | 5/1950 | Jay | 273/326 |
| 3,788,941 | 1/1974 | Kupits | 273/173 UX |
| 3,910,578 | 10/1975 | Brine | 273/96 D |
| 4,138,111 | 2/1979 | Rule | 273/96 D |
| 4,153,251 | 5/1979 | Pond | 273/326 |
| 4,270,756 | 6/1981 | Ahlenfeld et al. | 273/326 |
| 4,657,260 | 4/1987 | Brine | 273/326 |
| 4,861,042 | 8/1989 | Trettin | 273/326 |
| 4,940,243 | 7/1990 | Tucker et al. | 273/326 |

*Primary Examiner*—William H. Grieb

*Attorney, Agent, or Firm*—Lorusso & Loud

[57] ABSTRACT

A lacrosse stick head comprising a frame and netting attached to the frame, the frame comprising a throat wall, a side wall extending from the throat wall, and a lip portion joined to an end of the side wall, the netting being configured to define a ball pocket, a rib on the throat wall extending inwardly therefrom, and a ball stop member secured to said throat wall with an edge of said ball stop member adjacent said rib.

8 Claims, 5 Drawing Sheets

LACROSSE STICK HEAD WITH A THROAT WALL RIB AND BALL STOP MEMBER

BACKGROUND OF THE INVENTION

1. Field of the Invention

This invention relates to lacrosse sticks and is directed more particularly to a lacrosse stick head having throat wall stiffening means, the stiffening means further serving as a ball stop member positioning means and still further serving to conceal an edge of the ball stop member.

2. Description of the Prior Art

Lacrosse sticks include head portions attached to stick handles. The head portion comprises a frame which includes a throat wall, side wall means, and a lip portion. Interiorly of the frame there is disposed a netting which includes a ball pocket. A ball stop member usually is affixed to the interior surface of the throat wall.

The frames of lacrosse stick heads are commonly made from plastic materials affording lightness and toughness to the frame. However, a problem that causes some concern in plastic frames is a lack of rigidity in the side to side dimension. Because of weight limitations, manufacturers are unable to compensate by simply substantially increasing the thickness of the frame walls.

In attempts to provide added rigidity to the frame, flanges have been molded on the outer side walls of the frames. U.S. Pat. No. 4,657,260, issued Apr. 14, 1987 in the name of William H. Brine, Jr. illustrates several embodiments of frame side walls provided with flanges on their outer surfaces. However, placing a reinforcing rib on the outer surface of the throat wall is impractical because the throat area must be adapted to receive an end of a stick handle for connection to the head frame.

Another concern in the manufacture of lacrosse sticks is the placement of the ball stop member, which usually is of a relatively soft and resilient material. Typically, the ball stop member, which essentially is a soft rubbery-like pad, is secured by hand to the interior surface of the throat wall with adhesive. In fabrication of the head frame, the ball stop member frequently is misaligned with the upper edge of the throat wall, presenting a less than attractive appearance to a prospective customer and player, particularly if adhesive is in view. Even when aligned correctly, the upper edge of the ball stop member is exposed alongside the upper edge of the throat wall. Whereas the molded plastic frame generally presents a sleek and appealing appearance, the exposed ball stop member edge is of a different character and tends to detract from a otherwise stylish appearance. Adhesive inadvertently applied to the throat wall edge further detracts from the appearance of the head.

Accordingly, it would be beneficial to provide the throat wall of the frame with means for increasing the rigidity thereof. Further, it would be beneficial if means were provided to facilitate the proper orientation of the ball stop member as it is being applied to the throat wall inner surface. Still further, it would be desirable to provide means for concealing the otherwise exposed ball stop member edge.

SUMMARY OF THE INVENTION

It is, therefore, an object of the invention to provide a rib on the interior surface of a lacrosse stick head frame throat wall so as to increase the rigidity of the wall and thereby increase the side to side rigidity of the frame.

It is a further object of the invention to provide a rib as described immediately above which is adapted to serve as a guide for the placement of a ball stop member on the interior surface of the throat wall.

It is a still further object of the invention to provide such a rib so placed as to conceal the upper edge of the ball stop member when the ball stop member is fixed in place on the throat wall.

With the above and other objects in view, as will hereinafter appear, a feature of the present invention is the provision of a lacrosse stick head comprising a frame and netting attached to the frame, the frame comprising a throat wall, side wall means extending from the throat wall, and a lip portion joined to an end of the side wall means remote from the throat wall, the netting being configured to define a ball pocket, rib means on the throat wall extending inwardly therefrom, and a ball stop member secured to the throat wall with an edge of the ball stop member being adjacent the rib means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 2:
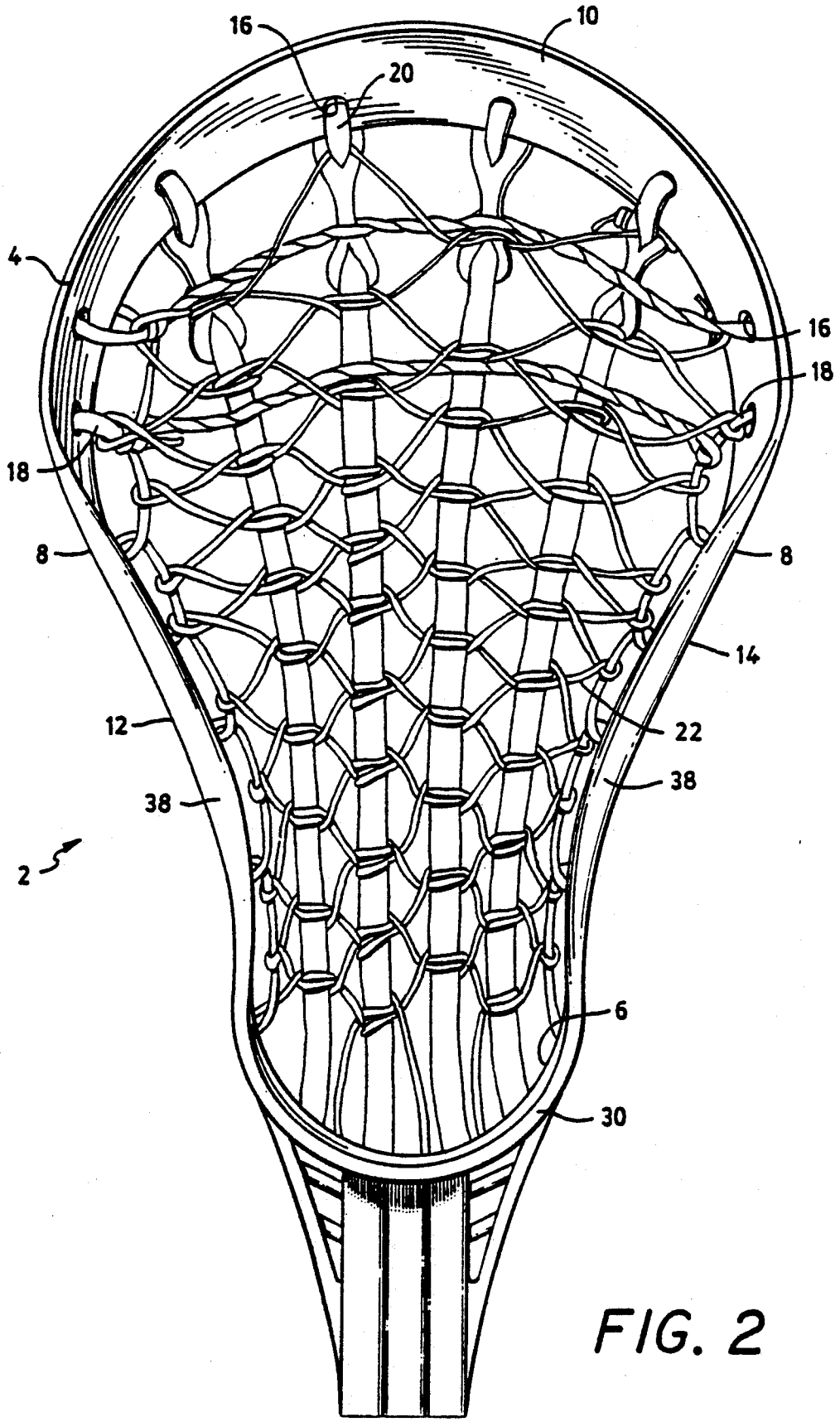
FIG. 2 is a top plan view of a lacrosse stick head, including the frame shown in FIG. 1, less the ball stop member.
Figure 3:
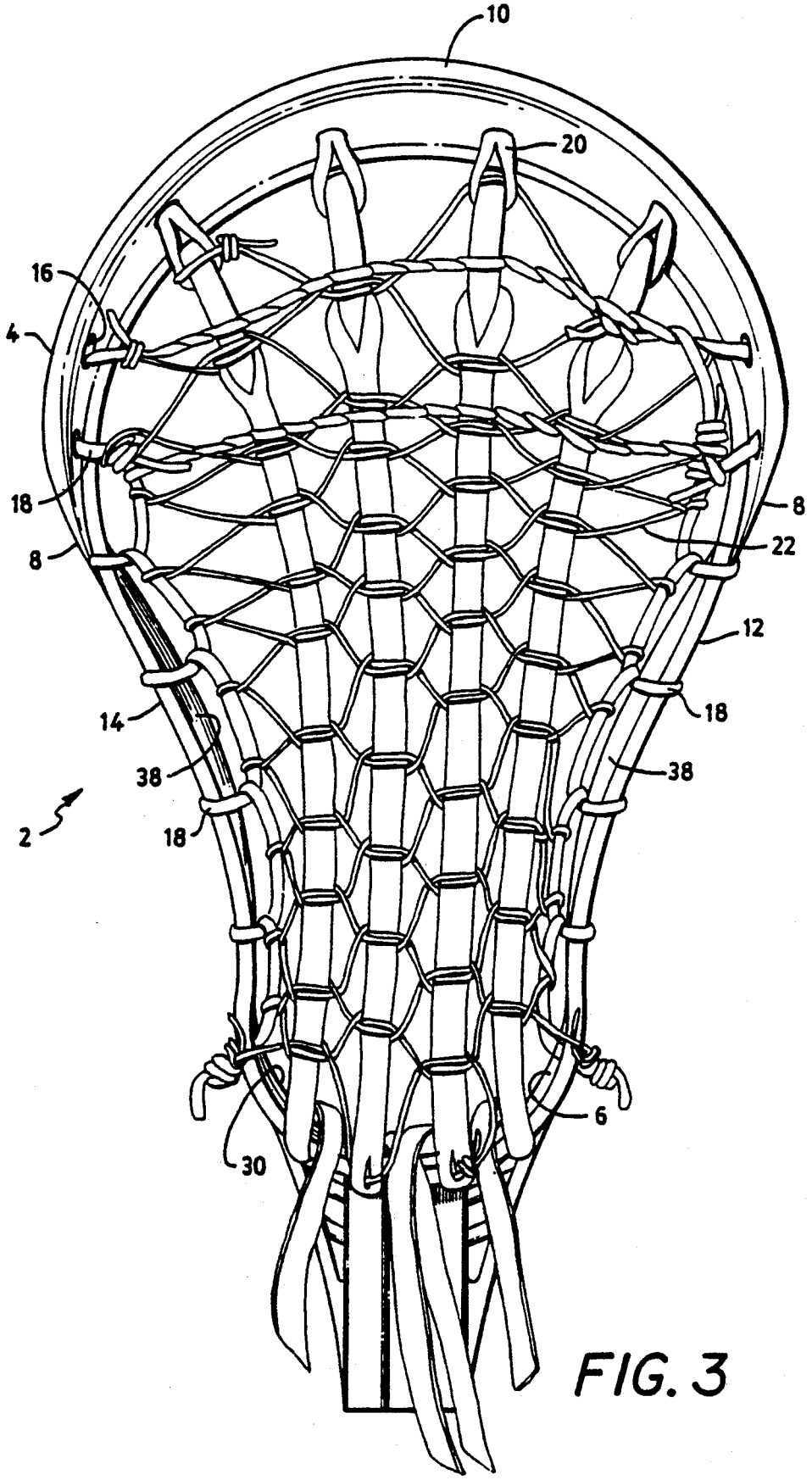
FIG. 3 is a bottom view of the head shown in FIG. 2.

Referring to the drawings, and particularly FIGS. 2 and 3, it will be seen that an illustrative lacrosse stick head portion 2 includes a frame 4 having a throat portion 6 from which extend side wall means 8. A distal end of the side wall means 8 joins a lip portion 10 of the frame. The side wall means 8 generally include two side walls 12, 14 as illustrated in the drawings, but may comprise only one side wall. The frame 4 may be of wood, but in recent times predominantly has been constructed of a substantially rigid, light-weight plastic, such as a nylon, a polyurethane, or mixtures of thermoplastic polymers.

The throat portion 6, the side wall means 8 and the lip portion 10 are provided with holes 16 (FIG. 1) in which are disposed portions 18, 20, respectively (FIGS. 2 and 3), of a netting 22. The netting 22 is thus attached to, and retained by, the frame 4.

Figure 1:
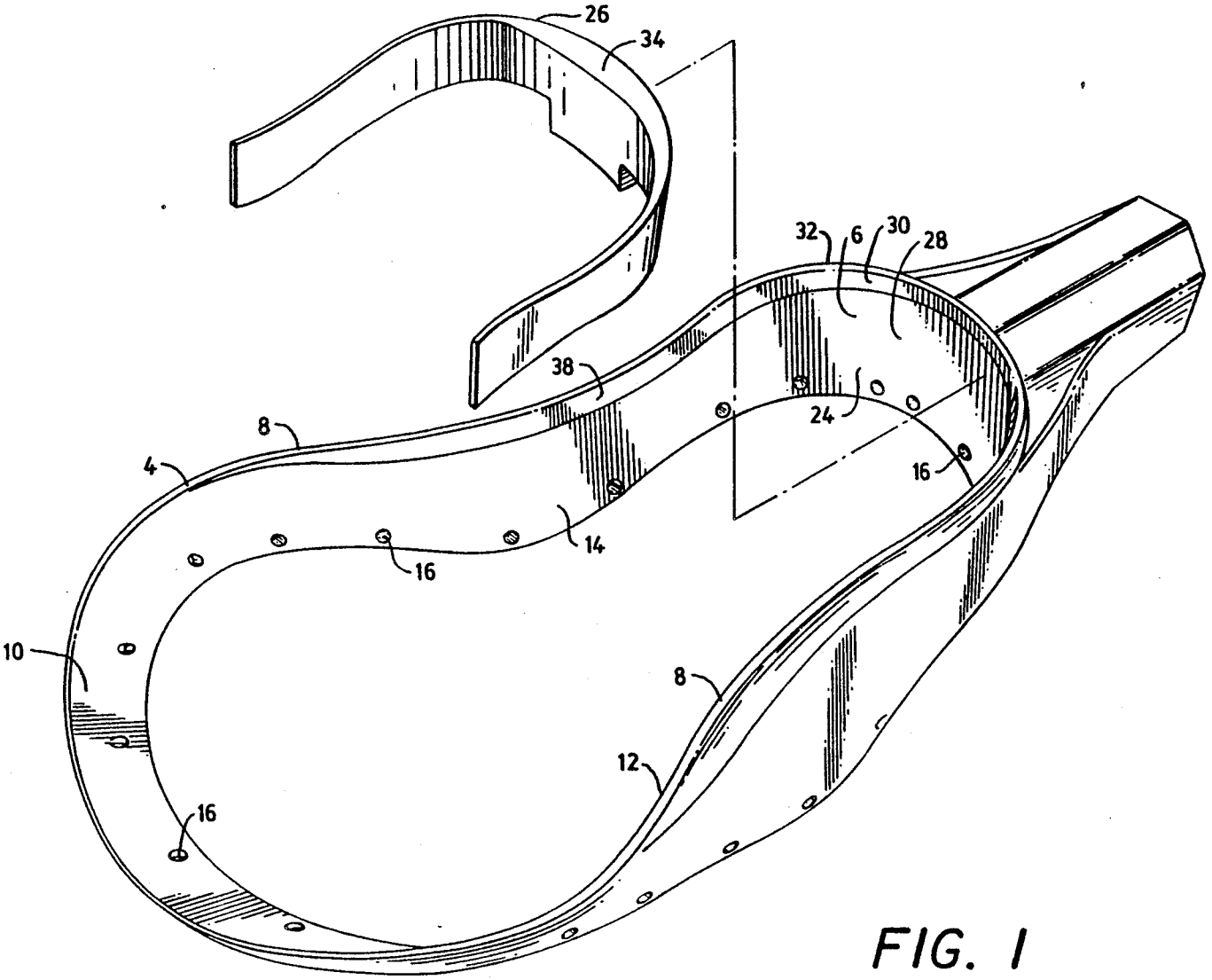
FIG. 1 is an exploded perspective view of one form of lacrosse stick head frame illustrative of an embodiment of the invention.
Figure 4:
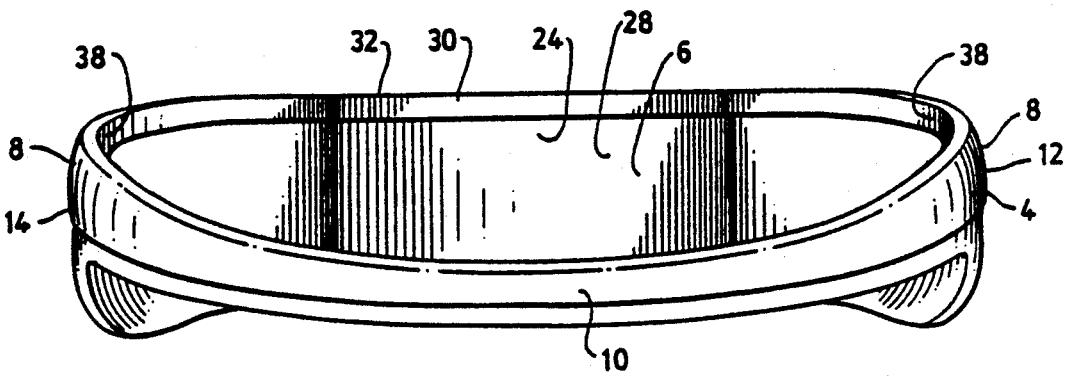
FIG. 4 is a front elevational view of the frame shown in FIG. 1, less the ball stop member.
Figure 5:
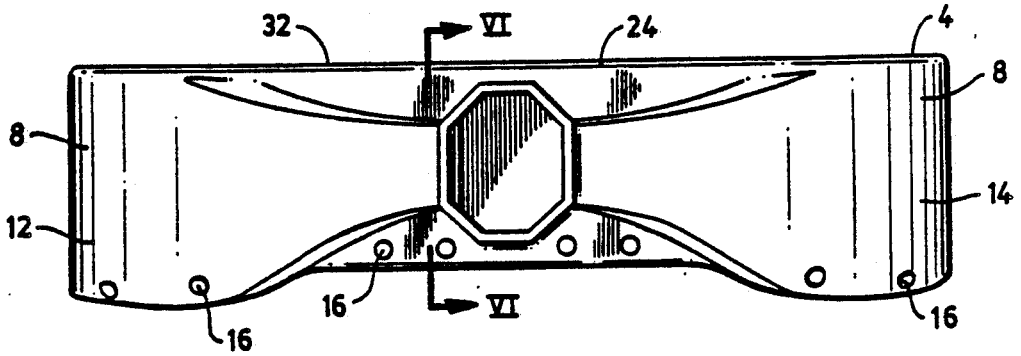
FIG. 5 is a rear elevational view of the frame shown in FIG. 4.

As may be seen in FIGS. 1 and 4, the two side walls 12, 14 converge into a throat wall 24.

Referring to FIG. 1, it will be seen that the throat wall 24 has attached thereto a relatively soft and spongy ball stop member 26, against which a ball (not shown) may lie when carried by a player in the throat portion 6 of the head and which may act to stop a ball passed from another player. The ball stop member 26 typically is provided with a tacky surface and during assembly of the stick in manufacture, or, in some instances, after purchase, the tacky surface is applied to an interior surface 28 of the throat wall, whereby to secure the ball stop member 26 to the throat wall 24.

In accordance with the present invention, the throat wall 24 is provided with rib means 30 extending from the interior surface 28 of the throat wall 24. The rib means 30, which comprises a flange-like protrusion extending from the interior surface 28 of the throat wall 24 and substantially normal thereto (FIG. 6), serves to add rigidity to the frame. Further, the rib means is disposed proximate an upper edge 32 of the throat wall to serve as a guide for the proper placement of the ball stop member 26 by simply placing an upper edge 34 (FIG. 1) of the ball stop member against an undersurface 36 (FIG. 6) of the rib means 30. Upon completion of the ball stop member attaching step, the upper edge 34 of the ball stop member is concealed by underlying the rib means 30.

Figure 6:
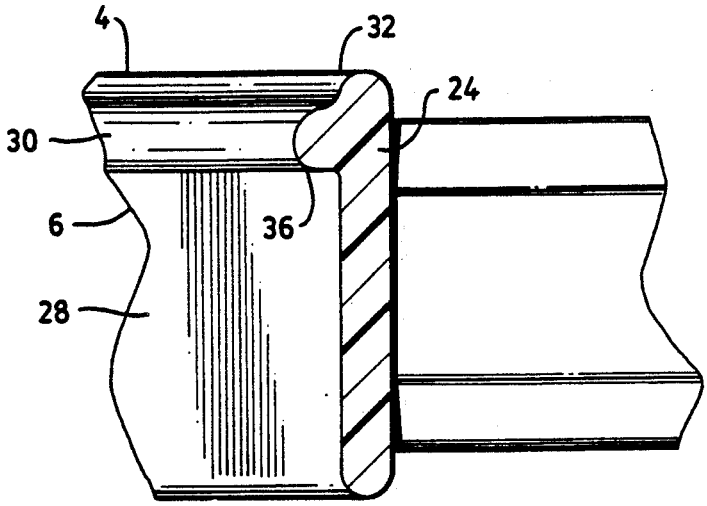
FIG. 6 is a sectional view taken along line VI—VI of FIG. 5.

As noted above, the frame portion, including the throat wall, of most present-day lacrosse sticks is of molded plastic. It is preferable that the rib means 30 be molded integrally with the frame, as shown in FIG. 6.

In U.S. Pat. Application, Ser. No. 07,627,326, filed Dec. 14,1990, in the name of William H. Brine III, Peter J. Brine, and Klon R. Ervin, there is disclosed a lacrosse stick head frame having rib means on interior surfaces of the side walls thereof, the rib means extending inwardly to overlie marginal portions of the netting. In this embodiment of frame, which is illustrated in FIGS. 1–4 herein, the throat wall rib means 30 may extend into side wall rib means 38.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A lacrosse stick head comprising a frame and netting attached to said frame, said frame comprising a throat wall, side wall means extending from said throat wall, and a lip portion joined to an end of said side wall means remote from said throat wall, said netting being configured to define a ball pocket, rib means on said throat wall extending inwardly therefrom, and a ball stop member secured to said throat wall with an edge of said ball stop member adjacent said rib means.

2. The lacrosse stick head in accordance with claim 1 in which rib means extend inwardly from interior surfaces of said side wall means and said throat wall rib means comprises a continuation of said side wall rib means.

3. The lacrosse stick head in accordance with claim 2 in which said side wall means comprise first and second side walls and said side wall rib means comprise first and second side wall rib means, said throat rib means comprising a continuation of said first and second side wall rib means.

4. The lacrosse stick head frame in accordance with claim 1 in which said ball stop member comprises a resilient pad.

5. The lacrosse stick head frame in accordance with claim 4 in which said resilient pad is adhesively secured to said throat wall.

6. The lacrosse stick head frame in accordance with claim in which said throat wall rib means is disposed proximate an upper edge of said throat wall.

7. The lacrosse stick head frame in accordance with claim 6 wherein said throat wall rib means comprises a flange-like protrusion extending from an interior surface of said throat wall and substantially normal thereto.

8. The lacrosse stick head frame in accordance with claim 7 wherein said throat wall is of molded plastic material and said rib means are molded integrally with said throat wall.

* * * * *